United States Patent [19]

Simard

[11] Patent Number: 4,788,770

[45] Date of Patent: Dec. 6, 1988

[54] SCRAPER FOR SCRATCH COUPONS

[76] Inventor: Rodrigue Simard, 3361 Bélair, Sherbrooke, Quebec, Canada J1L 1B3

[21] Appl. No.: 64,247

[22] Filed: Jun. 19, 1987

[51] Int. Cl.[4] ..... B26B 3/00

[52] U.S. Cl. ..... 30/169; 30/296 A; 206/371

[58] Field of Search ..... 30/169–172, 30/296 R, 296 A; 206/371; 15/236 R; 248/309.1, 311.2, 314; 7/160

[56] References Cited

U.S. PATENT DOCUMENTS 4,044,980 8/1977 Cummins ..... 206/371 X 4,141,452 2/1974 Martin et al. ..... 248/309.1 X 4,654,923 4/1987 Faciane et al. ..... 30/169 X

*Primary Examiner*—Douglas D. Watts

[57] ABSTRACT

There is disclosed a scraper which is intended to replace the use of a coin, a knife or the like to remove the waxy like surface of a scratch coupon, such as a lottery scratch coupon. The scraper includes a blade having a sharp scraping edge at one end and a holding part at the other end. It also comprises a blade holder formed of a slot like chamber to receive and hold the blade like member. The blade holder has a base support to enable the blade holder to stand rearwardly inclined when placed on a horizontal surface. The blade like member is attached to the blade holder.

2 Claims, 1 Drawing Sheet

SCRAPER FOR SCRATCH COUPONS

BACKGROUND OF INVENTION (a) Field of Invention

This invention relates to a scraper for scratch coupons. More particularly, the present invention relates to device which is intended to replace the use of a coin, a knife or the like, in order to remove the waxy like surface covering possibly winning combinations of for example a lottery scratch coupon or the like.

(b) Description of Prior Art

Scratch coupons are very well known and are widely used by lottery organization and also for drawing all kinds of prizes. In these types of coupons one or more winning numbers or combinations are covered with a waxy like material. It is then merely necessary to scratch these covered portions to discover if the number or combination is a lucky one.

In practice, a coin or a knive is used to remove the waxy like substance. This is not always practical and is certainly not convenient. In addition for the distributor of the coupons, this means that the person buying it awaits to arrive at home before scratching it. If on the other hand, a device would readily be available to scratch the covered number or combination, the distributor would face the possibility of selling many more coupons to unlucky buyers.

SUMMARY OF THE INVENTION

It is therefore an object of the present invention to provide a scraper for scratch coupons which is readily available to the buyers of the coupons.

It is another object of the present invention to provide a scraper for scratch coupons which includes a blade like member and a blade holder. The blade like member has a sharp scraping edge at one end and a holding part at the opposite end. The blade holder is formed with a slot like chamber to receive and hold the blade like member. The blade holder also comprises a base support which is designed to enable the blade holder to stand with a rearward inclination when placed on a horizontal surface. Means are provided to attach the blade like member at the holding part of the blade holder.

BRIEF DESCRIPTION OF DRAWINGS

In the drawings which illustrate the invention.

DESCRIPTION OF PREFERRED EMBODIMENT

Figure 1:
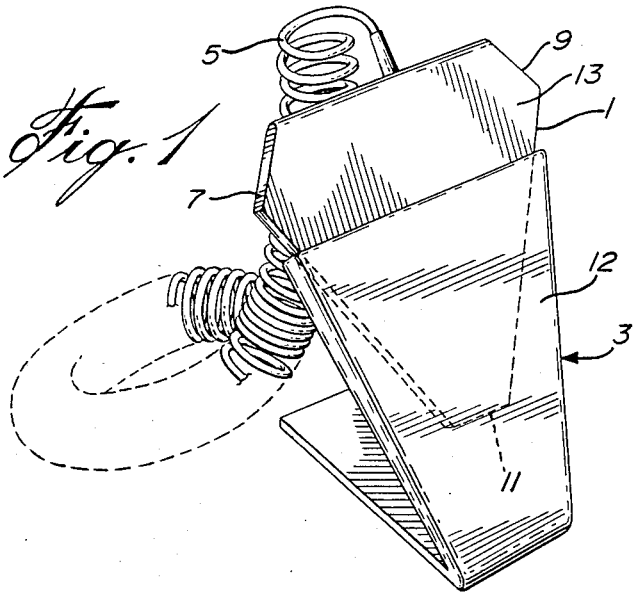
FIG. 1 is a perspective view of a scraper according to the invention.
Figure 2:
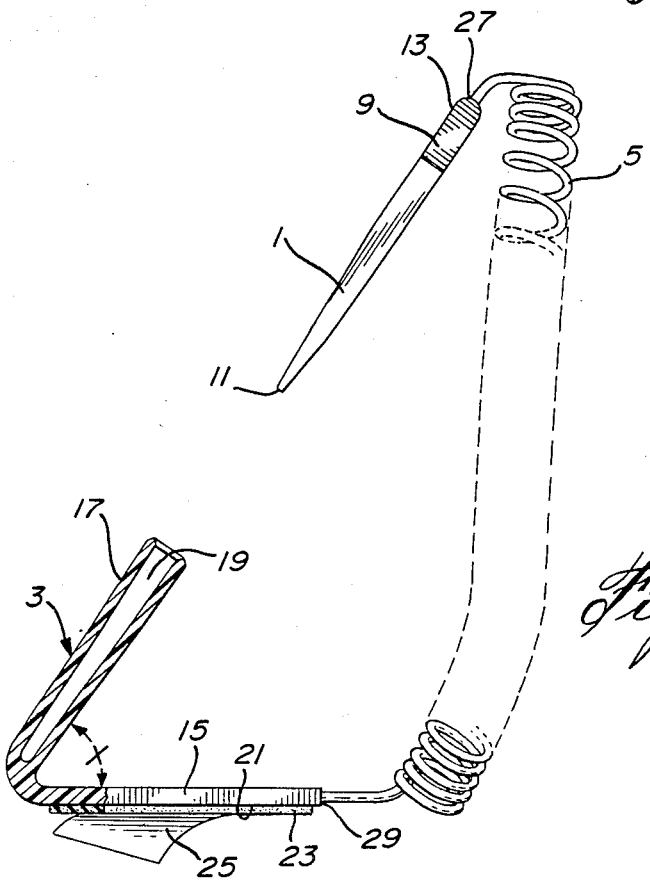
FIG. 2 is a vertical cross-section through the device illustrated in FIG. 1.

Referring to the drawings it will be seen that the device illustrated generally comprises a blade 1, a blade holder 3 and a coiled cord 5 connecting the blade to the blade holder.

The blade 1 could be of any shape desired. However, for design purposes, in the model illustrated, it is generally trapezoidal with cut out corners 7 and 9. At the bottom end, where the side is the narrower, the edge 11 is sharp so as to permit the scraping away of a waxy like substance covering a number or a combination which may be the lucky one. The upper end of the blade 1 has a holding part 13 located between the cut out corners 7 and 9.

Turning now to the blade holder 3, it will be seen to consist of a base support 15 joined at an angle $\alpha$ with upright portion 17, so that the latter be slightly rearwardly inclined when placed on a horizontal surface. The upright portion 17 of the blade holder 3 is formed with a slot like chamber 19 which is shaped to receive and hold the blade 1 as shown in FIG. 1.

Turning now to the base support 15, it will be seen to have affixed to its underface 21 a self adhesive tape portion 23 having a releasable cover sheet 25.

Finally, for practical purpose, the holding part 13 is connected to the base support 15, respectively at 27 and 29 by means of the coiled cord 5.

Such a device can simply be affixed to a horizontal surface after having removed releasable cover sheet 25, where it is ready to be used. After having bought a scratch coupon, the customer picks up the blade 1 by lifting it up from its holder 3, and using the sharp edge 11, he scrapes away any waxy like substance from a concealed number or combination, and then replace the blade 1 in the slot like chamber 19.

I claim:

1. A scraper for scratch coupons comprising a blade like member having a sharp scraping edge at one end thereof and a holding part at opposite end, a blade holder formed with a slot like chamber to receive and hold said blade like member, said blade holder comprising a base support unitary with said blade holder enabling said blade holder to stand with a rearward inclination when placed on a horizontal surface, and a coiled cord to attach said blade like member at said holding part to said blade like holder, said cord to retract to original length after having removed the blade like member from said blade holder and returned same therein.

2. A scraper for scratch coupons according to claim 1 which comprises adhesive means associated with said blade support to enable to fix said base support at a selected location on said horizontal surface.

* * * * *